US005432956A

United States Patent [19]

Park

[11] Patent Number: 5,432,956

[45] Date of Patent: Jul. 18, 1995

[54] POTTY SEAT WITH LIQUID-FILLED CHAMBER

[76] Inventor: Cynthia C. Park, 805 N. Cypress, Wichita, Kans. 67206

[21] Appl. No.: 286,449

[22] Filed: Aug. 5, 1994

[51] Int. Cl.[6] ..... A47K 13/06

[52] U.S. Cl. ..... 4/239; 4/237; 4/661

[58] Field of Search ..... 4/235, 237, 239, 661

[56] References Cited

U.S. PATENT DOCUMENTS

| | | | |
|---|---|---|---|
| 3,171,138 | 3/1965 | Brunelle | 4/237 |
| 3,251,072 | 5/1966 | Breed | 4/239 |
| 3,982,288 | 9/1976 | Borne | 4/237 |
| 4,069,522 | 1/1978 | Messmer et al. | 4/483 |
| 4,193,142 | 3/1980 | Henningfield | 4/483 |
| 4,244,764 | 1/1981 | Ginsburg | 4/237 X |
| 4,364,132 | 12/1982 | Robinson | 4/546 |
| 4,744,113 | 5/1988 | Kogut | 4/661 |
| 4,777,680 | 10/1988 | Paz | 4/484 |
| 5,008,964 | 4/1991 | Dean et al. | 4/661 |
| 5,117,515 | 6/1992 | White, Jr. et al. | 4/661 |
| 5,123,130 | 5/1992 | Sanders | 4/661 |
| 5,182,823 | 2/1993 | Alsip | 4/661 |

*Primary Examiner*—Robert M. Fetsuga

[57] ABSTRACT

A child's potty seat includes a ring-shaped cushion and a liquid-filled chamber which is formed between the cushion and an outer wall which is secured to the cushion. The outer wall is transparent, and decorative indicia within the chamber are visible through the outer wall. The decorative indicia move with the liquid as the outer wall moves toward and away from the cushion. An electronic chip mounted in the potty seat is compressed when the potty seat is used and emits music.

10 Claims, 2 Drawing Sheets

POTTY SEAT WITH LIQUID-FILLED CHAMBER

BACKGROUND

This invention relates to children's potty seats, and, more particularly, to a potty seat which includes a liquid-filled chamber and indicia within the liquid which move with the liquid.

Potty seats are commonly available for toilet training children. A potty seat is designed to be mounted on a conventional toilet seat. The central opening of the potty seat is smaller than the central opening of a conventional adult-sized toilet seat so that a child can sit comfortably on the potty seat.

Even though a potty seat is sized for a child, many children have a great deal of apprehension about using a potty seat. As a result, toilet training a child can be a tedious and time-consuming task.

SUMMARY OF THE INVENTION

The invention provides a padded potty seat with a liquid-filled chamber and indicia immersed in the liquid which move with the liquid. A portion of the chamber is compressed when a child sits on the potty seat, and the compressive force causes the liquid and the indicia to move within the chamber. The child soon learns that his or her body movements on the potty seat cause further movement of the indicia within the chamber. The child's attention is captured by the moving indicia, and a child's fear or apprehension of using the potty seat is greatly diminished. The comfort of the potty seat is enhanced by foam padding and by the liquid-filled chamber. The potty seat is also equipped with an electronic music chip which plays music when it is compressed. The music chip is activated when the child sits on the potty seat, and the music also reduces the child's apprehension.

DESCRIPTION OF THE DRAWING

The invention will be explained in conjunction with an illustrative embodiment shown in the accompanying drawing, in which.

DESCRIPTION OF SPECIFIC EMBODIMENT

Figure 2:
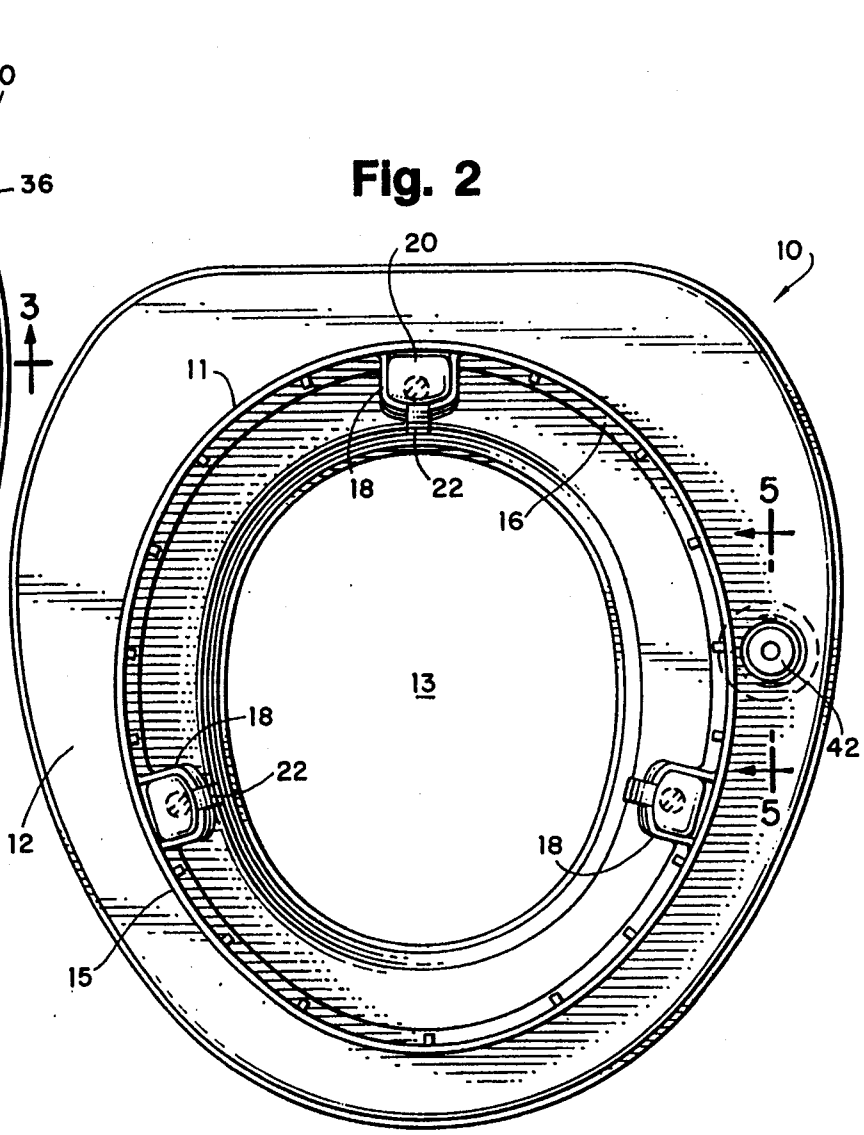
FIG. 2 is a bottom plan view of the potty seat.

The numeral 10 designates generally a potty seat which includes a frame 11 and a cushion 12. Both the frame and the cushion are generally ring-shaped or oval-shaped and provide the potty seat with a central opening 13.

In the embodiment illustrated, the frame 11 includes a generally cylindrical wall 15 which is sized and shaped to be inserted into the central opening of both conventional toilet seat, and elongated toilet seats. Alternatively, the potty seat can be used independently of a conventional toilet by mounting the potty seat in a potty chair. The frame 11 would then be configured for mounting on the potty chair.

An annular top wall 16 extends inwardly from the side wall 15 and supports the cushion 12. A plurality of triangular ribs 17 connect the side wall 15 and top wall 16 and reinforce the walls. The frame can advantageously be molded integrally from plastic.

The frame includes three integral attaching lugs 18 which extend inwardly from the side wall 15 and top wall 16. A screw 19 extends through an opening in each lug into the cushion for securing the cushion to the frame. Each screw is covered by a cap 20 which includes pins 21 which are press-fitted into openings in the lug. The cap is connected to the lug by an integral flexible strap 22.

The cushion 12 includes a relatively rigid and relatively flat base 23 and a pad 24 which is formed from compressible and resilient material such as urethane foam. The base and pad are enclosed by an outer layer or cover 25 of plastic sheet material such as vinyl. The cover can be formed from top and bottom sheets 26 and 27 which are sonic welded, heat-sealed, or otherwise secured along inner and outer seams 28 and 29.

Figure 3:
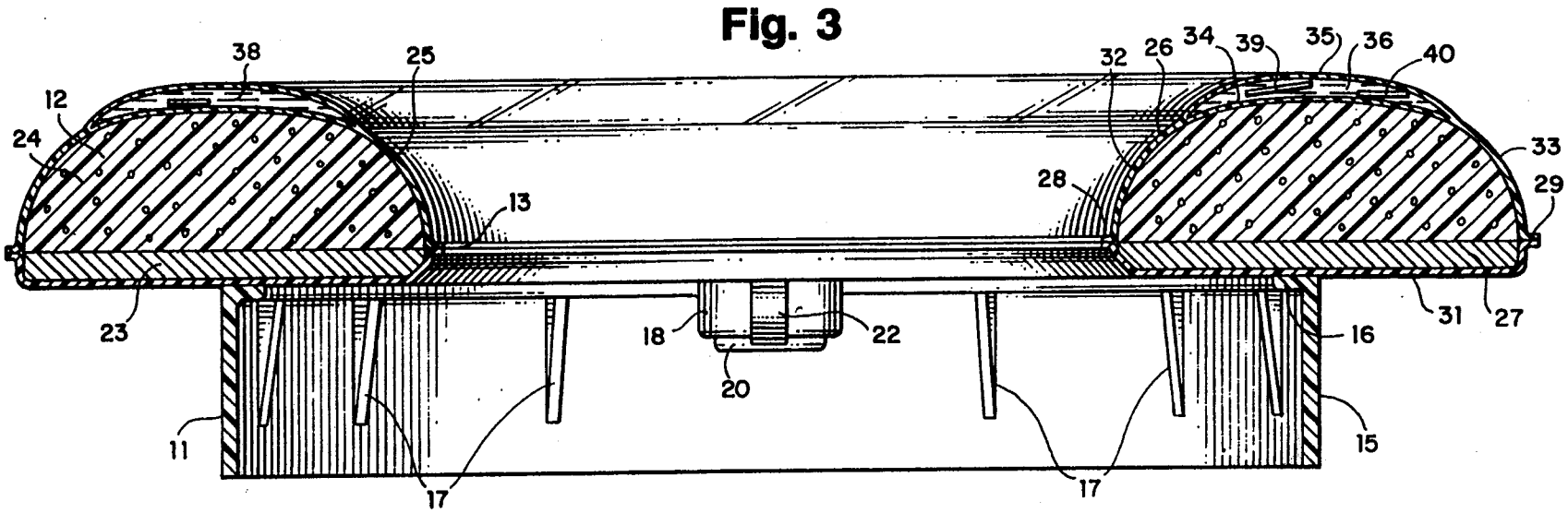
FIG. 3 is a sectional view taken along the line 3—3 of FIG. 1.
Figure 6:
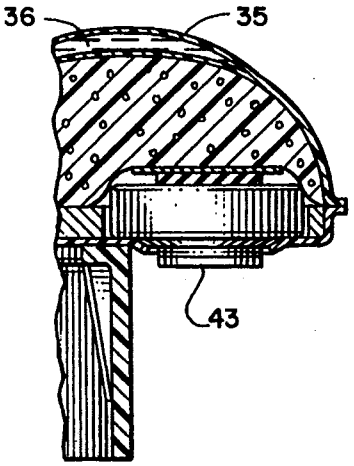
FIG. 6 is a fragmentary sectional view taken along the line 6—6 of FIG. 5.
Figure 5:
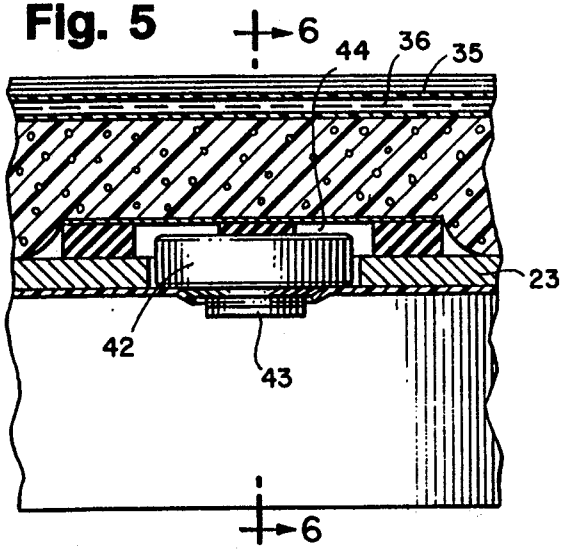
FIG. 5 is a fragmentary sectional view taken along the line 5—5 of FIG. 2.
Figure 4:
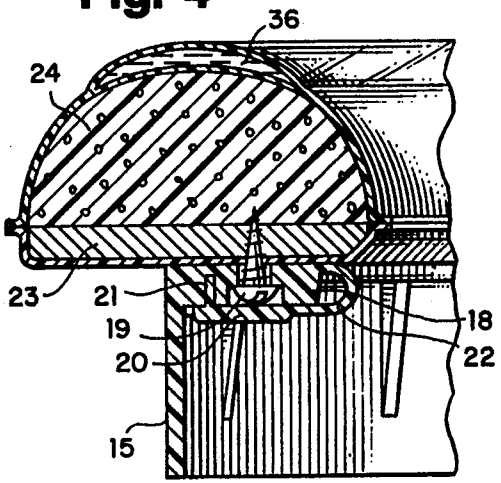
FIG. 4 is a fragmentary sectional view taken along the line 4—4 of FIG. 1.

Referring to FIG. 3, the cushion includes a flat bottom 31, upwardly curved inside and outside surfaces 32 and 33, and a convex top surface 34. An outer wall 35 is secured to the cushion above the top surface 34 and forms a chamber 36 therebetween. The outer wall extends around the entire circumference of the cushion so that the chamber 36 is continuous and ring-shaped. The outer wall is formed from transparent material such as transparent vinyl or other plastic, and the outer wall is secured to the cover 25 of the cushion by sonic welding, heat sealing, or the like to form a liquid-tight chamber.

Figure 1:
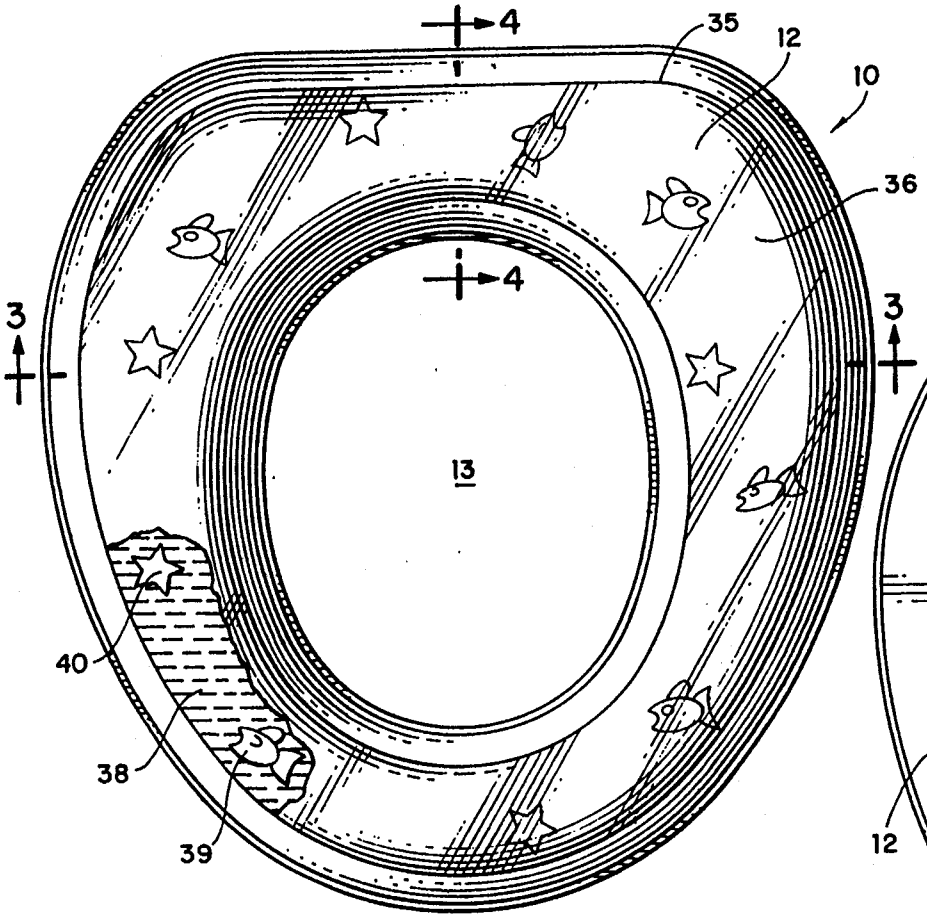
FIG. 1 is a top plan view of a potty seat formed in accordance with the invention.

The chamber 36 is filled with liquid 38 such as water, and a plurality of small objects or indicia 39 and 40 (FIGS. 1 and 3) are immersed in the liquid. The indicia 39 and 40 are visible through the transparent outer wall 35 and are decorative and eye-catching so that they will be a source of fascination, friendliness, and amusement for a child. In the particular embodiment illustrated, the indicia 39 are shaped like fish, and the indicia 40 are shaped like stars. However, other shapes could be used. The indicia 39 and 40 are advantageously cut or stamped from plastic sheet material, for example, vinyl. However, hard plastic or other material can also be used.

The outer wall 35 and the top of the cushion 12 are flexible, and when a chid sits on the potty seat, the portion of the chamber 36 on which the child sits is compressed. The liquid in the compressed portions is forced to flow into the uncompressed portions, and the liquid currents cause the indicia 39 and 40 to move within the chamber. The indicia 39 and 40 exhibit rapid and spontaneous movement which attracts the child's attention and tends to make the child forget any apprehension about sitting on the potty seat. The liquid-filled chamber also increases the softness and comfort of the seat, particularly compared to hard plastic seats which are commonly available.

As the child shifts his or her weight on the potty seat, different portions of the chamber 36 are compressed and uncompressed, causing additional movement of the liquid and the indicia 39 and 40. The child soon learns that his or her body movements affects the movements of the indicia. The child's attention is thereby directed even more to the movement of the indicia.

The density of the indicia need not be less than the density of the liquid. The liquid currents cause the indicia to move through the chamber as if they were floating within the liquid even though the indicia are denser than the liquid. When the indicia are formed from thin plastic sheet material, they have little resistance to moving through the liquid.

If desired, additional eye-catching indicia can be imprinted on the top surface 34 of the cushion which forms the bottom of the chamber 36 and also along the sides 32 and 33. The printed indicia are stationary but will serve to increase the eye appeal of the potty seat.

An electronic music chip 42 FIGS. (2, 5, and 6) is mounted in the base 23 of the cushion outwardly of the side wall 15 of the frame. The music chip is a conventional and well known commercial item which includes a depressible button portion 43. When the button portion 43 is depressed, the music chip emits pre-programmed music or sounds such as voices. One particular music chip is Part No. BST-OIM from Bliss of Taipei, Taiwan.

The music chip is positioned within a cavity 44 in the base 23 and the pad 24, and the push button portion 43 extends below the base. The push button portion is engageable with the toilet seat and is depressed when the child sits on the potty seat. The music distracts the child from any apprehension of sitting on the potty seat.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A child's potty seat comprising:

a generally ring-shaped frame adapted to be mounted on a toilet seat, a compressible and resilient generally ring-shaped cushion mounted on the frame, the cushion having an inside surface forming a central opening in the cushion, a top surface, and an outside surface, a transparent outer wall attached to the cushion and forming a chamber between the outer wall and the cushion, a liquid confined within the chamber, and a plurality of indicia within the liquid which are visible through the transparent outer wall.

2. The potty seat of claim 1 in which the outer wall is secured to the top surface of the cushion.

3. The potty seat of claim 1 in which the liquid is water.

4. The potty seat of claim 3 in which the indicia are formed from plastic sheet.

5. The potty seat of claim 1 in which the outer is flexible whereby a compressive force on the outer wall will move the liquid and the indicia within the liquid.

6. The potty seat of claim 5 in which the outer wall is formed from plastic which is sealed to the cushion.

7. The potty seat of claim 6 in which the cushion includes a plastic outer layer, the plastic outer wall being sealed to the plastic outer layer of the cushion.

8. The potty seat of claim 1 including an electronic music chip mounted in the potty seat and adapted to emit musical sounds when a child sits on the potty seat.

9. The potty seat of claim 8 in which the electronic music chip is mounted in the cushion and is adapted to engage the toilet seat.

10. The potty seat of claim 8 in which the cushion includes a base having a relatively flat bottom surface and the electronic music chip is mounted in the base and extends below the bottom surface.

* * * * *